US011257465B2

(12) United States Patent
Liu et al.

(10) Patent No.: US 11,257,465 B2
(45) Date of Patent: Feb. 22, 2022

(54) BRIGHTNESS-UNEVENNESS COMPENSATION METHOD AND DEVICE, AND DISPLAY PANEL

(71) Applicant: Xianyang Caihong Optoelectronics Technology Co., Ltd, Xianyang (CN)

(72) Inventors: Zihan Liu, Xianyang (CN); Yuyeh Chen, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 17/192,146

(22) Filed: Mar. 4, 2021

(65) Prior Publication Data

US 2021/0287626 A1 Sep. 16, 2021

(30) Foreign Application Priority Data

Mar. 12, 2020 (CN) ..... 202010171559.6

(51) Int. Cl.
*G09G 5/10* (2006.01)
*G09G 3/36* (2006.01)

(52) U.S. Cl.
CPC ..... *G09G 5/10* (2013.01); *G09G 3/3607* (2013.01); *G09G 2310/027* (2013.01); *G09G 2310/08* (2013.01); *G09G 2320/0233* (2013.01); *G09G 2320/0646* (2013.01)

(58) Field of Classification Search
CPC .. G09G 5/10; G09G 3/3607; G09G 2310/027; G09G 2310/08; G09G 2320/0233; G09G 2320/0646
See application file for complete search history.

(56) References Cited

U.S. PATENT DOCUMENTS

| | | | | |
|---|---|---|---|---|
| 2017/0193928 | A1* | 7/2017 | Deng | G09G 3/20 |
| 2018/0122282 | A1* | 5/2018 | He | G09G 3/2088 |
| 2018/0122284 | A1* | 5/2018 | Zhang | G09G 3/2007 |
| 2019/0197935 | A1* | 6/2019 | Kim | G09G 3/20 |
| 2020/0013326 | A1* | 1/2020 | Zheng | G09G 3/20 |
| 2021/0150257 | A1* | 5/2021 | Wang | G06K 9/6212 |
| 2021/0264833 | A1* | 8/2021 | Heo | G09G 3/20 |

* cited by examiner

*Primary Examiner* — Antonio Xavier
(74) *Attorney, Agent, or Firm* — WPAT, PC

(57) ABSTRACT

A brightness-unevenness compensation method and device and a display panel are provided. The method includes: obtaining brightness-unevenness information of a display panel and a plurality of gray-scale compensation data for compensating brightness-unevenness of the display panel; storing the plurality of gray-scale compensation data in a manner of a compensation table with a plurality of compensation data groups having different compensation distances being associated with the same number of data bits and in both vertical and horizontal directions; reading the plurality of compensation data groups from the compensation table and compensating gray-scale data to-be-displayed to obtain compensated gray-scale data, after the display panel is powered on; and outputting the compensated gray-scale data for picture display. Through a dynamic variable block size mode, a block size of 8×8 pixels is used for a conventional brightness-unevenness, and a block size with a higher precision is selected for a smaller brightness-unevenness.

6 Claims, 4 Drawing Sheets

| block type | Data amount in the prior method |
|---|---|
| 8X8 BLOCK | 4.7Mbits |
| 4X4 BLOCK | 18.72Mbits |
| 2X2 BLOCK | 74.76Mbits |
| 1X1 BLOCK | 298.6Mbits |

| block type | maximum compensatable block (group) | comments |
|---|---|---|
| 8X8 BLOCK | 481X271 | A size of a flash is 8 Mbits, and an area consisting of 8×8 pixels is taken as one group. |
| 4X4 BLOCK | 15000 | |
| 2X2 BLOCK | 4300 | |
| 1X1 BLOCK | 1100 | |

FIG. 3

Four types of block size (2 bits)

Data of previous line

Next block information

Current block information

00
8 x 8

| | 1 | 2 | 3 | 4 | 5 | 6 | 7 | 8 | 9 |
|---|---|---|---|---|---|---|---|---|---|
| 1 | | | | | | | | | |
| 2 | | | | | | | | | |
| 3 | | | | | | | | | |
| 4 | | | | | | | | | |
| 5 | | | | | | | | | |
| 6 | | | | | | | | | |
| 7 | | | | | | | | | |
| 8 | | | | | | | | | |
| 9 | | | | | | | | | |

01
4 x 4

| | 1 | 2 | 3 | 4 | 5 | 6 | 7 | 8 | 9 |
|---|---|---|---|---|---|---|---|---|---|
| 1 | | | | | | | | | |
| 2 | | | | | | | | | |
| 3 | | | | | | | | | |
| 4 | | | | | | | | | |
| 5 | | | | | 1 | | | | 2 |
| 6 | | | | | | | | | |
| 7 | | | | | | | | | |
| 8 | | | | | | | | | |
| 9 | | | | | 3 | | | | 4 |

10
2 x 2

| | 1 | 2 | 3 | 4 | 5 | 6 | 7 | 8 | 9 |
|---|---|---|---|---|---|---|---|---|---|
| 1 | | | | | | | | | |
| 2 | | | | | | | | | |
| 3 | | | 1 | | 2 | | 3 | | 4 |
| 4 | | | | | | | | | |
| 5 | | | 5 | | 6 | | 7 | | 8 |
| 6 | | | | | | | | | |
| 7 | | | 9 | | 10 | | 11 | | 12 |
| 8 | | | | | | | | | |
| 9 | | | 13 | | 14 | | 15 | | 16 |

11
1 x 1

| | 1 | 2 | 3 | 4 | 5 | 6 | 7 | 8 | 9 |
|---|---|---|---|---|---|---|---|---|---|
| 1 | | | | | | | | | |
| 2 | | 1 | 2 | 3 | 4 | 5 | 6 | 7 | 8 |
| 3 | | 9 | 10 | 11 | 12 | 13 | 14 | 15 | 16 |
| 4 | | 17 | 18 | 19 | 20 | 21 | 22 | 23 | 24 |
| 5 | | 25 | 26 | 27 | 28 | 29 | 30 | 31 | 32 |
| 6 | | 33 | 34 | 35 | 36 | 37 | 38 | 39 | 40 |
| 7 | | 41 | 42 | 43 | 44 | 45 | 46 | 47 | 48 |
| 8 | | 49 | 50 | 51 | 52 | 53 | 54 | 55 | 56 |
| 9 | | 57 | 58 | 59 | 60 | 61 | 62 | 63 | 64 |

FIG. 5

BRIGHTNESS-UNEVENNESS COMPENSATION METHOD AND DEVICE, AND DISPLAY PANEL

TECHNICAL FIELD

The disclosure relates to the field of liquid crystal displaying technologies, and in particular to a brightness-unevenness compensation method and a brightness-unevenness compensation device, and a display panel.

DESCRIPTION OF RELATED ART

Most of the existing liquid crystal displays are backlight type liquid crystal displays, each including a housing, and a liquid crystal panel and a backlight module arranged in the housing. Generally, the liquid crystal panel is composed of a Color Filter (CF) substrate, a Thin Film Transistor (TFT) array substrate and a liquid crystal layer filled between the CF substrate and the TFT array substrate. A working principle of the liquid crystal panel is that: driving voltages are applied on the CF substrate and TFT array substrate to control the rotation of liquid crystal molecules in the liquid crystal layer, thereby to control a light output and refracting the light from the backlight module to generate a picture.

After the production of the display panels, due to the limitation of a manufacturing process, the display panels will have different degrees of brightness unevenness (mura or gray-scale mura). The existing Demura (brightness-unevenness compensation) technology is a compensation technology for a brightness unevenness caused by the production process of the display panels to compensate gray-scales of mura areas of the display panels. The Demura technology is performed through following steps: firstly, taking displaying pictures of a display panel at different gray-scales by a CCD camera, obtaining or extracting mura information of the display panel, then, obtaining gray-scale compensation data of the mura by an algorithm according to between brightness and darkness difference of the displaying pictures, and finally obtaining a compensation table (Demura table) of a selected gray-scale, using to be called by a hardware and corrected by the hardware. The compensation table is usually burned in a storage device (such as, flash).

After a timing controller (Tcon IC or TCON) is powered on, gray-scale data to-be-displayed is compensated by the gray-scale compensation data to obtain compensated gray-scale data, and then the compensated gray-scale data is outputted for picture display, thereby improving a brightness and darkness uniformity of the display panel.

However, the existing Demura technology performs data compression according to a fixed block size (a block capacity or an area range). For example, a block size of a display panel with a resolution of 3840×2160 commonly is 8×8 pixels, that is, pixels with a size of 8×8 each share a compensation (data) value, so each compensation table stored in the flash has a size of 481×271, and compensation data of the pixels is obtained by an interpolation calculation. The existing Demura technology has the characteristics of high efficiency and cost saving, but also has some following shortcomings.

1. A mura with a size smaller than 8×8 pixels cannot be compensated due to a precision limitation of block size;

2. A mura with a high sharpness, such as an H-line mura, a V-line mura, etc., cannot be addressed by an interpolation calculation method, and the compensation effect is poor;

3. The above problems can be addressed through improving the precision of the block size, however, a size of the required compensation table increases correspondingly when the precision of the block size is improved uniformly, and then the amount of information (data) increases. As shown in FIG. 1, a capacity demand for the flash and SRAM(Static Random-Access Memory) in the TCON greatly increases, and then a hardware cost increases. However, a Demura flash used in a current 4K screen usually only has a size of 8 Mbits.

SUMMARY

In order to solve at least one technical problem in the prior art, the disclosure provides a brightness-unevenness compensation (Demura) method, a brightness-unevenness compensation (Demura) device, and a display panel. The technical problems to be solved by the disclosure are realized by the following technical solutions.

According to one aspect of the present disclosure, a brightness-unevenness compensation (Demura) method for a display panel is provided, including following steps:

step 1, obtaining brightness-unevenness (mura) information and multiple gray-scale compensation data for compensating brightness-unevenness;

step 2, storing the plurality of gray-scale compensation data in a manner of a compensation table with multiple compensation data groups having different compensation distances being associated with the same number of data bits and in both vertical and horizontal directions;

step 3, reading the plurality of compensation data groups from the compensation table and compensating gray-scale data to-be-displayed to obtain compensated gray-scale data, after the display panel is powered on; and step 4, outputting the compensated gray-scale data for picture display.

In an embodiment of the disclosure, the different compensation distances include at least one of 1, 2, 4, and 8; the compensation table is configured to record the plurality of gray-scale compensation data; and each of the plurality of compensation data groups includes a block size (block capacity) type-identifier and at least one compensation value.

In an embodiment of the disclosure, the different compensation distances are specifically set according to compensation requirements, and may be greater or smaller than 8, and for example is 10 or 12.

In an embodiment of the disclosure, the step of reading the plurality of compensation data groups from the compensation table and compensating gray-scale data to-be-displayed to obtain compensated gray-scale data, after the display panel is powered on, includes: transmitting each of the plurality of gray-scale compensation data groups, through a double data rate (DDR) synchronous dynamic random access memory for compensation of 8×8 pixels; performing an automatic selection matching between one of multiple block sizes and the at least one compensation value corresponding to the block size type-identifier according to the block size type-identifier of each of the plurality of compensation data groups; and compensating the mura after performing an interpolation calculation, or compensating directly the mura without performing of interpolation calculation.

In an embodiment of the disclosure, the block size type-identifier has a size of 2 bits and is located before the at least one compensation value corresponding to the block size type-identifier and further used to identify the block size matched to the at least one compensation value; the plurality of block sizes have different type of precisions and are used for data compression with a dynamic variable precisions for different mura; the plurality of block sizes having different type of precisions include: a block size of 8×8 pixels; a block size of 4×4 pixels; a block size of 2×2 pixels; a block size of 1×1 pixel; the compensation table capable of being applied to the plurality of block sizes having different type of precisions; a data amount corresponding to the block size of 8×8 pixels of the compensation table is 14 bits; a data amount corresponding to the block size of 4×4 pixels of the compensation table is 50 bits; a data amount corresponding to the block size of 2×2 pixels of the compensation table is 194 bits; and a data amount corresponding to the block size of 1×1 pixel of the compensation table is 770 bits.

In an embodiment of the disclosure, the different mura include a mura phenomenon with a size greater than or equal to 8×8 pixels and a mura with a size smaller than 8×8 pixels; a format of each of the plurality of compensation data groups is a combination of the block size type-identifier and the at least one compensation value; the block size of 8×8 pixels is used for the mura with the size greater than or equal to 8×8 pixels uses; a block size with a precision smaller than 8×8 pixels is used for the mura with the size smaller than 8×8 pixels; the mura with the size smaller than 8×8 pixels include a dot mura, a horizontal line mura and a vertical line mura.

In an embodiment of the disclosure, the different brightness-unevenness phenomena include: a whole line mura in a horizontal or vertical direction, a band mura in the horizontal or vertical direction and periodic cyclic horizontal or vertical stripes; each of the plurality of compensation data groups further includes coordinate information; and a format of each of the plurality of compensation data groups is a combination of the block size type-identifier, the coordinate information and the at least one compensation value.

In an embodiment of the disclosure, for the whole line mura in the horizontal or vertical direction, the interpolation calculation is performed using 3 to 5 compensation values; for the band mura in the horizontal or vertical direction, the interpolation calculation is performed using two compensation values for the same pixel, where one of the two compensation values is used for an interpolation on one side, and the other one of the two compensation values is used for an interpolation on the other side; for the periodic cyclic horizontal or vertical stripes, 3 to 5 groups of compensation coefficients are used to multiply the compensation value(s) to correct the compensation values of periodic cyclic horizontal or vertical stripes and perform an independent compensation.

Another aspect of the disclosure provides a Demura device, adapted for a display panel, including: an obtaining unit, configured to obtain mura information and multiple gray-scale compensation data for compensating brightness-unevenness; a storing unit, configured to store the plurality of gray-scale compensation data in a manner of a compensation table with multiple compensation data groups having different compensation distances being associated with the same number of data bits and in both vertical and horizontal directions; a calculating unit, configured to read the plurality of compensation data groups from the compensation table and compensating gray-scale data to-be-displayed to obtain compensated gray-scale data, after the display panel is powered on; and an outputting unit, configured to output the compensated gray-scale data for picture display; where the obtaining unit, the storing unit, the calculating unit and the outputting unit are implemented in a timing control (TCON) chip, a flash (a nonvolatile memory with a long-life), a driving circuit and a circuit board of the display panel.

The present disclosure further provides a display panel, includes the Demura device described above.

Compared with the prior art, the disclosure has the following beneficial effects.

The brightness-unevenness compensation (Demura) method, a brightness-unevenness compensation (Demura) device and the display panel of the present disclosure adopt a dynamically variable block mode, and define a format of each compensation data group as a combination of a block identifier and a compensation value, thereby a capacity of a flash and a capacity of an SRAM (Static Random-Access Memory) in a TCON is saved; a block size of 8×8 pixels is used for a conventional mura, and a block size with a higher precision is selected for a smaller mura, a mura can be compensated with a higher precision under the condition of effectively saving memory space. Taking a flash with a capacity of 8M bytes as an example, for 3 planes and 12 bits, 15,000 groups of a block size of 4×4 pixels are compensated at most, or 4,300 groups of a block size of 2×2 pixels are compensated at most, or 1,100 groups of a block size of 1×1 pixel are compensated at most. Therefore, Under the condition of saving the capacity of the flash and the capacity of the SRAM in the TCON, mura with different sizes can be compensated effectively, and the dynamic variable block mode can realize differential compensation of different panels.

The above description is only an overview of the technical solutions of the disclosure, which can be implemented according to the contents of the specification in order to understand the technical solutions of the disclosure more clearly, and in order to make the above and other objects, features and advantages of the disclosure more obvious and easy to understand, the following detailed description is given with reference to the drawings.

BRIEF DESCRIPTION OF THE DRAWINGS

FIG. 3 is a schematic table of compensable block types and amounts thereof for an 8M flash of 3-plane and 12 bits according to an embodiment of the disclosure;

FIG. 5 is a schematic diagram of four blocks controlled by a block size type-identifier having a size of 2 bits according to an embodiment of the disclosure.

DETAILED DESCRIPTION OF EMBODIMENTS

In order to further explain the technical solutions and efficacy of the disclosure for achieving the intended invention purpose, the Demura method, the Demura device and the display panel according to the disclosure will be described in detail with reference to the accompanying drawings and specific embodiments.

The foregoing and other technical contents, features and effects of the disclosure can be clearly presented in the following detailed description of the specific embodiments with the accompanying drawings. Through the description of specific embodiments, deeper and specific understanding of the technical means and efficacy of the disclosure for achieving the intended purpose. However, the accompanying drawings are only for reference and explanation, and are not used to limit the technical solutions of the disclosure.

First Embodiment

Figures 1, 2:
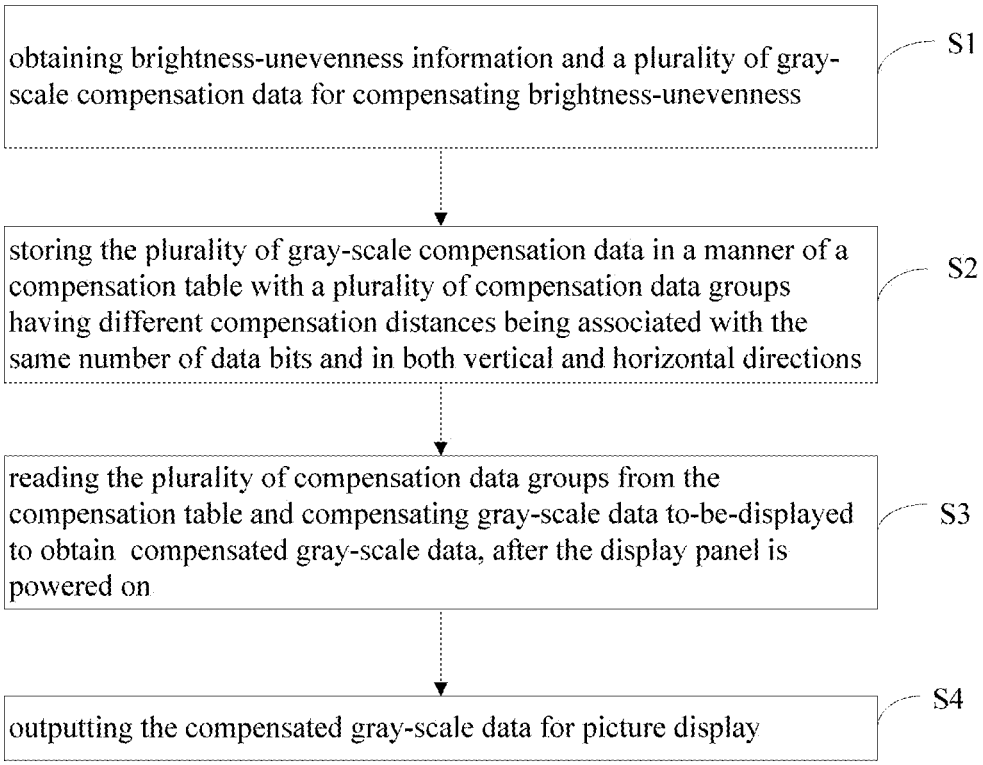
FIG. 1 (Prior Art)
FIG. 1 is a schematic table of a block type and a data amount of an existing Demura technology.
FIG. 2 is a schematic flow chart of a Demura method according to an embodiment of the disclosure.

Referring to FIG. 2, a schematic flow chart of a Demura (also referred to brightness-evenness compensation) method for a display panel according to an embodiment of the disclosure is shown, which includes following steps:

S1, obtaining brightness-unevenness (mura) information and multiple gray-scale compensation data for compensating brightness-unevenness;

S2, storing the plurality of gray-scale compensation data in a manner of a compensation table with multiple compensation data groups having different compensation distances being associated with the same number of data bits and in both vertical and horizontal directions;

S3, reading the plurality of compensation data groups from the compensation table and compensating gray-scale data to-be-displayed to obtain compensated gray-scale data, after the display panel is powered on; and S4, outputting the compensated gray-scale data for picture display.

In the embodiment, the different compensation distances include at least one of 1, 2, 4, and 8; the compensation table is configured to record the plurality of gray-scale compensation data; and each of the plurality of compensation data groups includes a block size (block capacity) type-identifier and at least one compensation value. different compensation distances are specifically set according to compensation requirements, and may be greater or smaller than 8, and for example is 10 or 12, other technical contents can be adjusted synchronously, which can be easily realized by those skilled in the art inspired by the following embodiments, and will not be repeated in detail herein.

Further, step S3 includes:

S31, transmitting each of the plurality of gray-scale compensation data groups, through a double data rate (DDR) synchronous dynamic random access memory for compensation of 8×8 pixels;

S32, performing an automatic selection matching between one of multiple block sizes and the at least one compensation value corresponding to the block size type-identifier according to the block size type-identifier of each of the plurality of compensation data groups; and S33, compensating the mura after performing an interpolation calculation, or compensating directly the mura without performing of interpolation calculation.

Further, in the embodiment, the block size type-identifier has a size of 2 bits and is located before the at least one compensation value corresponding to the block size type-identifier and is used to identify the block size matched to the at least one compensation value; the plurality of block sizes have different type of precisions and are used for data compression with a dynamic variable precisions for different mura; the plurality of block sizes having different type of precisions include: a block size of 8×8 pixels; a block size of 4×4 pixels; a block size of 2×2 pixels; a block size of 1×1 pixel; where the compensation table capable of being applied to the plurality of block sizes having different type of precisions; a data amount corresponding to the block size of 8×8 pixels of the compensation table is 14 bits; a data amount corresponding to the block size of 4×4 pixels of the compensation table is 50 bits; a data amount corresponding to the block size of 2×2 pixels of the compensation table is 194 bits; and a data amount corresponding to the block size of 1×1 pixel of the compensation table is 770 bits.

Further, in the embodiment, many different precisions or different types of mura can be compensated, including a mura phenomenon with a size greater than or equal to 8×8 pixels and a mura with a size smaller than 8×8 pixels; a format of each of the plurality of compensation data groups is a combination of the block size type-identifier and the at least one compensation value; the block size of 8×8 pixels is used for the mura with the size greater than or equal to 8×8 pixels uses; a block size with a precision smaller than 8×8 pixels is used for the mura with the size smaller than 8×8 pixels; the mura with the size smaller than 8×8 pixels include a dot mura, a horizontal line mura and a vertical line mura.

For the Demura method of the disclosure, a mura with larger sharpness, such as a dot mura, a horizontal line mura, a vertical line mura, etc. can be compensated through a smaller data amount.

Specifically, in the embodiment, a dynamic variable block size is used, and includes a block size of 8×8 pixels, a block size of 4×4 pixels, a block size of 2×2 pixels, a block size of 1×1 pixel, and the block size is selected according to a size and type of a mura. The gray-scale compensation data group is transmitted for compensation of 8×8 pixels, and there is identifier information having a size of 2 bits before the compensation value corresponding to the block size type-identifier, and used to identify the block size matched to the compensation value, so that a block dynamic variable design can be realized and a storage space can be effectively used. The information amount of each compensation data group including "an identifier+a compensation value" is: 14 bits for the block size of 8×8 pixels, 50 bits for the block size of 4×4 pixels, 194 bits for the block size of 2×2 pixels, and 770 bits for the block size of 1×1 pixel. Taking an 8M flash of 3-plane and 12 bits as an example, the number of dot mura having a size of 1×1 pixel can be compensated up to 1100 groups, that is, up to 1100×64 pixels can be compensated one-to-one.

Please refer to FIG. 3, which is a schematic table of compensable block types and amounts thereof for an 8M flash of 3-plane and 12 bits according to an embodiment of the disclosure. Taking an 8M flash of 3-plane and 12 bits as an example, and the information amount or data amount is shown in FIG. 3. Therefore, when the required information (data) amount is too much, if the size of flash is not changed, the prior Demura technology can not compensate a mura with block precision of 4×4 pixels, 2×2 pixels and 1×1 pixel. The dynamical variable block size mode in the embodiment can compensate for special mura areas with a high precision, but usually muras with high sharpness in the panel, such as the dot mura, the horizontal line mura, the vertical line mura, etc., only occur in a few areas, so it is not necessary to perform a high precision process on each mura position.

Figure 4:
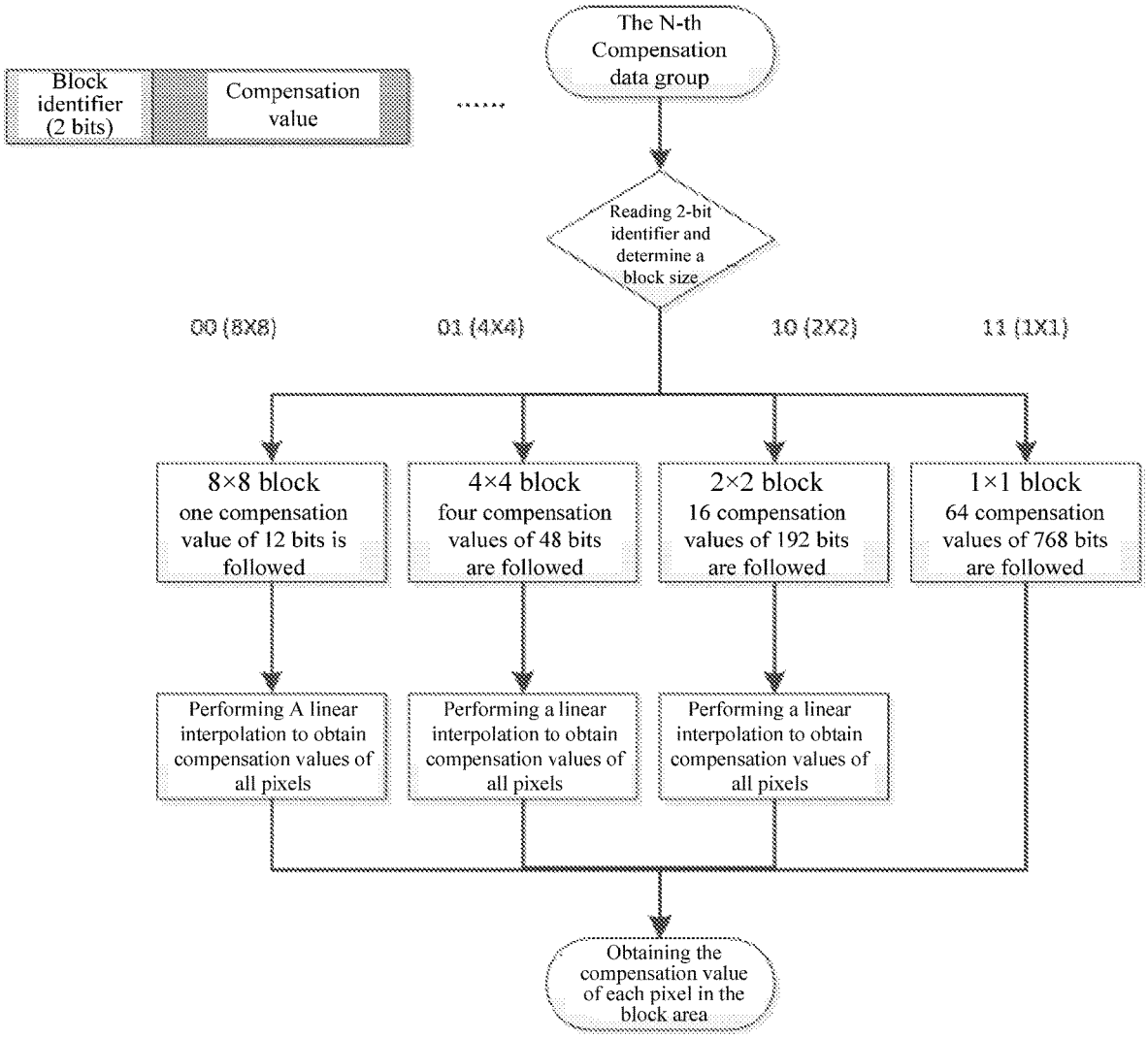
FIG. 4 is a schematic processing flow chart of each of compensation data groups according to an embodiment of the disclosure.

Further, referring to FIGS. 4 and 5, FIG. 4 is a schematic processing flow chart of each of compensation data groups according to an embodiment of the disclosure, and FIG. 5 is a schematic diagram of four blocks controlled by a block size type-identifier having a size of 2 bits according to an embodiment of the disclosure. For the N-th gray-scale compensation data group, a block size type-identifier having a size of 2 bits is firstly read and a block size is determined; a compensation value matched with the block size is read, a linear interpolation is performed to obtain gray-scale compensation values of all pixels so as to obtain a gray-scale compensation value of each pixel in the corresponding block area.

Specifically, in the embodiment, the preset 2-bit identifier "00" represents a block size of 8×8 pixels, the preset 2-bit identifier "01" represents a block size of 4×4 pixels, the preset 2-bit identifier "10" represents a block size of 2×2 pixels, and the preset 2-bit identifier "11" represents a block size of 1×1 pixel. An information amount or data amount of each compensation data group is calculated as follows: if the identifier is "00", that is, for the block size of 8×8 pixels, the compensation value of 1 pixel is included, which is 12 bits; If the identifier is "01", that is, for the block size of 4×4 pixels, compensation values of 4 pixels are included, which is 4×12 bits, with a total of 48 bits; If the identifier is "10", that is, for the block size of 2×2 pixels, compensation values of 16 pixels are included, which is 16×12 bits, with a total of 192 bits; If the identifier is "11", that is, for the block size of 1×1 pixels, compensation values of 64 pixels are included, which is 64×12 bits, with a total of 768 bits.

Further, when the 2-bit identifier is "00", one compensation value of 12 bits corresponding to the block size of 8×8 pixels following the identifier "00" is read, then a linear interpolation is performed to obtain compensation values of all pixels, and the compensation value of each pixel in the block area is finally obtained. When the 2-bit identifier is "01", four compensation values of 48 bits corresponding to the block size of 4×4 pixels following the identifier "01" is read, then a linear interpolation is performed to obtain compensation values of all pixels, and the compensation value of each pixel in the block area is finally obtained. When the 2-bit identifier is "10", 16 compensation values of 192 bits corresponding to the block size of 2×2 pixels following the identifier "10" is read, then a linear interpolation is performed to obtain compensation values of all pixels, and the compensation value of each pixel in the block area is finally obtained. When the 2-bit identifier is "11", 64 compensation values of 192 bits corresponding to the block size of 1×1 pixel following the identifier "11" is read, then a linear interpolation is performed to obtain compensation values of all pixels, and the compensation value of each pixel in the block area is finally obtained; and finally, the compensation of all types or precision block will be completed.

The brightness-unevenness compensation (Demura) method adopts a dynamical variable block mode, and define a data format as a combination of a block identifier and a compensation value, thereby a capacity of a flash and a capacity of an SRAM (static random-access memory) in a TCON is saved; a block size of 8×8 pixels is used for a conventional mura, and a block size with higher precision is selected for a smaller mura, a mura can be compensated with a higher precision under the condition of effectively saving memory space. Taking 8M flash of 3-plane and 12 bits as an example, 15,000 groups of 4×4 block areas are compensated at most, or 4,300 groups of 2×2 block areas are compensated at most, or 1,100 groups of 1×1 block areas are compensated at most. Therefore, Under the condition of saving the capacity of the flash and the capacity of the SRAM in the TCON, mura with different sizes can be compensated effectively, and the dynamic variable block can realize differential compensation of different panels.

Second Embodiment

On the basis of the above embodiments, the present embodiment provides another noval brightness-unevenness compensation (Demura) method.

In the embodiment, the mura includes: a whole line mura in a horizontal or vertical direction, a band mura in the horizontal or vertical direction and periodic cyclic horizontal or vertical stripes; the compensation data group further includes coordinate information; and a compensation data format is a combination of the block size type-identifier, the coordinate information and the at least one compensation value.

Further, on the basis of the above embodiments, for the whole line mura in the horizontal or vertical direction, the interpolation calculation is performed using 3 to 5 compensation values; for the band mura in the horizontal or vertical direction, the interpolation calculation is performed using two compensation values for the same pixel, where one of the two compensation values is used for an interpolation on one side, and the other one of the two compensation values is used for an interpolation on the other side; for the periodic cyclic horizontal or vertical stripes, 3 to 5 groups of compensation coefficients are used to multiply the compensation value(s) to correct the compensation values of periodic cyclic horizontal or vertical stripes and perform an independent compensation.

Specifically, the method described in the embodiment can be extended to deal with other special muras on the basis of the previous embodiments: for example, for the horizontal line and vertical line muras, a special treatment is carried out, and the compensation values are stored in the same way, and for the whole line mura (H-line, V-line) in the horizontal or vertical direction, 3-5 compensation values are only required for the interpolation calculation, and a format of the compensation data group is a combination of a block size type-identifier, coordinate information and a compensation value. For the band mura (H-band and V-band) in the horizontal or vertical direction, a special treatment is carried out, and the corresponding compensation values are stored in the same way. For a horizontal or vertical band mura (H-band, V-band), there are two compensation values for a same pixel, one of two compensation values for an interpolation on one side and the other of two compensation values for an interpolation on the other side, and the format of the compensation data group is a combination of a type-identifier, coordinate information and a compensation value. For periodic horizontal or vertical stripes, compensation is carried out separately, and 3-5 groups of compensation coefficients are shared and multiplied by compensation values and used for compensation value correction of periodic stripes, and the format of the compensation data group is a combination of a type-identifier, coordinate information and a compensation value.

In this way, the embodiment can effectively save data storage space, improve DDR transmission speed, and at the same time, can effectively compensate different muras such as the whole line mura, the band mura in the horizontal or vertical direction, and the periodic cyclic horizontal stripes or vertical stripes.

Third Embodiment

The present embodiment provides a Demura device, which is used for mura compensation of a display panel on the basis of the above embodiments. The device can be a virtual device, and can be abstractly implemented in a TCON (timing control) chip, a flash (a nonvolatile memory has a long-life), a driving circuit and a circuit board of the display panel, so as to achieve the effect of compensating mura of the display panel.

Specifically, the device includes: an obtaining unit, configured to obtain mura information and multiple gray-scale compensation data for compensating brightness-unevenness; a storing unit, configured to store the plurality of gray-scale compensation data in a manner of a compensation table with multiple compensation data groups having different compensation distances being associated with the same number of data bits and in both vertical and horizontal directions; a calculating unit, configured to read the plurality of compensation data groups from the compensation table and compensating gray-scale data to-be-displayed to obtain compensated gray-scale data, after the display panel is powered on; and an outputting unit, configured to output the compensated gray-scale data for picture display. The units store the gray-scale compensation data in the flash by acquiring mura information and the gray-scale compensation data, transmit the compensation data through the DDR, and finally output the compensated gray-scale data through the driving circuit to realize the normal picture display of the display panel.

The brightness-unevenness compensation (Demura) device of the embodiment adopts a dynamically variable block mode, and defines the data format as a combination of a block identifier and a compensation value, which can save a capacity of the flash and a capacity of the SRAM (Static Random-Access Memory) in the TCON. a block size of 8×8 pixels is used for a conventional mura of display panel, and a block with a higher precision is selected for a smaller mura, a mura is compensated with higher precision under the condition of effectively saving memory space. Therefore, Under the condition of saving the capacity of the flash and the capacity of the SRAM in the TCON, mura with different sizes can be compensated effectively, and the dynamic variable block can realize differential compensation of different panels.

The embodiment also provides a display panel, which includes the aforementioned Demura device on the basis of the aforementioned embodiments, adopts the aforementioned Demura method. A block size of 8×8 pixels is used for a conventional mura of display panel, and a block with a higher precision is selected for a smaller mura, a mura is compensated with higher precision under the condition of effectively saving memory space. Therefore, Under the condition of saving the capacity of the flash and the capacity of the SRAM in the TCON, mura with different sizes can be compensated effectively, and the dynamic variable block can realize differential compensation of different panels.

It should be noted that, the display panel and various existing Demura technologies can be acknowledged by the technicians in the field based on the prior art, and thus will not repeated herein, which not the reason for insufficient disclosure.

The above is a further detailed description of the disclosure combined with specific preferred embodiments, and it cannot be considered that the specific implementations of the disclosure is limited to these descriptions. For ordinary technicians in the technical field to which the disclosure belongs, several simple deductions or substitutions can be made without departing from the concept of the disclosure, which should be regarded as belonging to the protection scope of the disclosure.

What is claimed is:

1. A brightness-unevenness compensation method for a display panel, comprising:

obtaining brightness-unevenness information and a plurality of gray-scale compensation data for compensating brightness-unevenness;

storing the plurality of gray-scale compensation data in a manner of a compensation table with a plurality of compensation data groups having different compensation distances being associated with the same number of data bits and in both vertical and horizontal directions;

reading the plurality of compensation data groups from the compensation table and compensating gray-scale data to-be-displayed to obtain compensated gray-scale data, after the display panel is powered on; and outputting the compensated gray-scale data for picture display;

wherein the different compensation distances comprise at least one of 1, 2, 4, and 8;

wherein the compensation table is configured to record the plurality of gray-scale compensation data;

wherein each of the plurality of compensation data groups comprises a block size type-identifier and at least one compensation value; and wherein reading the plurality of compensation data groups from the compensation table and compensating gray-scale data to-be-displayed to obtain compensated gray-scale data, after the display panel is powered on, comprises:

transmitting each of the plurality of gray-scale compensation data groups, through a double data rate (DDR) synchronous dynamic random access memory, for compensation of 8×8 pixels;

performing an automatic selection matching between one of a plurality of block sizes and the at least one compensation value corresponding to the block size type-identifier according to the block size type-identifier of each of the plurality of compensation data groups; and compensating the brightness-unevenness after performing an interpolation calculation, or compensating directly the brightness-unevenness without performing of interpolation calculation.

2. The brightness-unevenness compensation method according to claim 1, wherein the different compensation distances are specifically set according to compensation requirements.

3. The brightness-unevenness compensation method according to claim 1, wherein the block size type-identifier has a size of 2 bits and is located before the at least one compensation value corresponding to the block size type-identifier and further used to identify the block size matched to the at least one compensation value;

the plurality of block sizes have different type of precisions and are used for data compression with dynamic variable precisions for different brightness-unevenness phenomena;

the plurality of block sizes having different type of precisions comprise:

a block size of 8×8 pixels;

a block size of 4×4 pixels;

a block size of 2×2 pixels;

a block size of 1×1 pixel;

the compensation table is capable of being applied to the plurality of block sizes having different type of precisions;

a data amount corresponding to the block size of 8×8 pixels of the compensation table is 14 bits;

a data amount corresponding to the block size of 4×4 pixels of the compensation table is 50 bits;

a data amount corresponding to the block size of 2×2 pixels of the compensation table is 194 bits; and a data amount corresponding to the block size of 1×1 pixel of the compensation table is 770 bits.

4. The brightness-unevenness compensation method according to claim 3, wherein the different brightness-unevenness phenomena comprise a brightness-unevenness phenomenon with a size greater than or equal to 8×8 pixels and a brightness-unevenness phenomenon with a size smaller than 8×8 pixels;

a format of each of the plurality of compensation data groups is a combination of the block size type-identifier and the at least one compensation value;

the block size of 8×8 pixels is used for the brightness-unevenness phenomenon with the size greater than or equal to 8×8 pixels uses;

a block size with a precision smaller than 8×8 pixels is used for the brightness-unevenness phenomenon with the size smaller than 8×8 pixels;

the brightness-unevenness phenomenon with the size smaller than 8×8 pixels comprises a dot mura, a horizontal line mura and a vertical line mura.

5. The brightness-unevenness compensation method according to claim 3, wherein the different brightness-unevenness phenomena comprise: a whole line mura in a horizontal or vertical direction, a band mura in the horizontal or vertical direction, and periodic cyclic horizontal or vertical stripes;

each of the plurality of compensation data groups further comprises coordinate information; and a format of each of the plurality of compensation data groups is a combination of the block size type-identifier, the coordinate information and the at least one compensation value.

6. The brightness-unevenness compensation method according to claim 5, wherein, for the whole line mura in the horizontal or vertical direction, the interpolation calculation is performed using 3 to 5 compensation values;

for the band mura in the horizontal or vertical direction, the interpolation calculation is performed using two compensation values for the same pixel, wherein one of the two compensation values is used for an interpolation on one side, and the other one of the two compensation values is used for an interpolation on the other side;

for the periodic cyclic horizontal or vertical stripes, 3 to 5 groups of compensation coefficients are used to multiply the compensation value(s) to correct the compensation values of periodic cyclic horizontal or vertical stripes and perform an independent compensation.

* * * * *